US010760289B2

(12) United States Patent
Schreyer

(10) Patent No.: US 10,760,289 B2
(45) Date of Patent: Sep. 1, 2020

(54) FORMWORK DEVICE

(71) Applicant: Doka NewCon GmbH, Amstetten (AT)

(72) Inventor: Bernd Schreyer, Reilingen (DE)

(73) Assignee: DOKA NEWCON GMBH, Amstetten (AT)

( * ) Notice: Subject to any disclaimer, the term of this patent is extended or adjusted under 35 U.S.C. 154(b) by 273 days.

(21) Appl. No.: 15/575,303

(22) PCT Filed: May 19, 2016

(86) PCT No.: PCT/EP2016/061220
§ 371 (c)(1),
(2) Date: Nov. 17, 2017

(87) PCT Pub. No.: WO2016/184947
PCT Pub. Date: Nov. 24, 2016

(65) Prior Publication Data

US 2018/0179769 A1 Jun. 28, 2018

(30) Foreign Application Priority Data

May 19, 2015 (DE) ..... 10 2015 209 157

(51) Int. Cl.
*E04G 9/08* (2006.01)
*E04G 11/08* (2006.01)
(Continued)

(52) U.S. Cl.
CPC ..... *E04G 9/083* (2013.01); *B28B 7/002* (2013.01); *B28B 7/08* (2013.01); *B28B 7/245* (2013.01);
(Continued)

(58) Field of Classification Search
CPC ..... E04G 9/083; E04G 11/08; E04G 15/02; E04G 19/003; E04G 9/10; E04B 1/04;
(Continued)

(56) References Cited

U.S. PATENT DOCUMENTS 447,804 A * 3/1891 Wooster et al. ..... B28B 7/087 249/137
1,314,018 A * 8/1919 Pipe ..... B28B 7/241 249/129
(Continued)

FOREIGN PATENT DOCUMENTS

AU 2016265189 B2 1/2019
CN 2144048 Y 10/1993
(Continued)

OTHER PUBLICATIONS

ISA European Patent Office, International Search Report Issued in Application No. PCT/EP2016/061220, dated Oct. 20, 2016, WIPO, 4 pages.
(Continued)

*Primary Examiner* — Xiao S Zhao
*Assistant Examiner* — Emmanuel S Luk
(74) *Attorney, Agent, or Firm* — McCoy Russell LLP

(57) ABSTRACT

The present invention relates to a formwork device for a battery formwork for the production of structural elements, in particular prefabricated concrete elements, which comprises at least two partition walls and the formwork device comprises two formwork panels that are connected to one another, preferably in an articulated manner, in order to be transferred from an unfolded state to a folded state, where each formwork panel comprises a formwork front side for attaching formwork elements and a formwork rear side, and the formwork rear sides of the two formwork panels face each other in the folded state and the formwork device is intended to be positioned in the folded state between the partition wall. The present invention further relates to an arrangement consisting of a battery formwork and at least one formwork device according to the invention, where the
(Continued)

formwork device is arranged suspended in the battery formwork.

16 Claims, 12 Drawing Sheets

(51) Int. Cl.

| | |
|---|---|
| ***E04G 15/02*** | (2006.01) |
| ***E04G 19/00*** | (2006.01) |
| ***B28B 7/24*** | (2006.01) |
| ***B28B 7/08*** | (2006.01) |
| ***B28B 7/00*** | (2006.01) |
| *E04B 1/04* | (2006.01) |
| *E04B 5/04* | (2006.01) |
| *E04B 7/20* | (2006.01) |

(52) U.S. Cl.
CPC ..... *E04G 11/08* (2013.01); *E04G 15/02* (2013.01); *E04G 19/003* (2013.01); *E04B 1/04* (2013.01); *E04B 5/04* (2013.01); *E04B 7/20* (2013.01); *E04B 2103/02* (2013.01)

(58) Field of Classification Search
CPC ..... E04B 5/04; E04B 7/20; E04B 2103/02; E04B 7/24; B28B 7/245; B28B 7/34
See application file for complete search history.

(56) References Cited

U.S. PATENT DOCUMENTS 1,462,186 A * 7/1923 Zenke ..... B22D 7/005 249/68
1,760,282 A * 5/1930 Pedersen ..... B28B 7/243 249/93
2,983,983 A * 5/1961 Mayer ..... B28B 5/025 249/129
3,097,397 A * 7/1963 Leach ..... B29C 33/00 249/79
3,110,949 A * 11/1963 Di Tullio ..... B28B 7/243 249/101
3,220,692 A * 11/1965 Eklund ..... B28B 7/243 249/161
3,307,821 A * 3/1967 Torricelli ..... B28B 7/241 249/129
3,360,231 A * 12/1967 Van Hezik ..... B28B 7/0088 249/129
3,488,817 A * 1/1970 Katz ..... B28B 7/02 425/441
3,511,467 A * 5/1970 Rohrer ..... B28B 7/02 249/118
3,519,243 A * 7/1970 Kleiber ..... B28B 7/245 249/119
3,576,303 A * 4/1971 Matson ..... B28B 1/087 248/672
3,628,766 A * 12/1971 Hartmann ..... B28B 7/243 249/19
3,724,805 A 4/1973 Kleiber et al.
3,743,235 A * 7/1973 Shelley ..... B28B 7/082 249/121
3,758,067 A * 9/1973 Kleiber ..... B28B 7/243 249/129
3,771,769 A * 11/1973 Niemi ..... B28B 1/087 366/118
3,785,608 A * 1/1974 Heinzman ..... B28B 7/0088 249/161
3,804,361 A * 4/1974 Camus ..... B28B 7/22 249/78
3,844,524 A * 10/1974 Fisher ..... B28B 7/243 249/120
3,859,021 A * 1/1975 Kleiber ..... B28B 5/04 425/186
3,873,058 A * 3/1975 Jeffery ..... B28B 7/243 249/161
3,881,856 A * 5/1975 Fougea ..... B28B 7/02 425/432
3,892,516 A * 7/1975 McGrew ..... B28B 7/243 425/443
3,954,377 A * 5/1976 Scholz ..... B28B 7/0041 425/432
4,008,990 A * 2/1977 Hiemer ..... B29C 44/428 425/454
4,067,941 A * 1/1978 Gaudelli ..... B28B 7/243 249/120
4,135,695 A * 1/1979 Capdevila ..... B28B 7/08 249/118
4,191,521 A * 3/1980 Muldery ..... B28B 7/243 249/101
4,534,924 A * 8/1985 Kariakin ..... E02D 31/00 249/120
4,614,325 A * 9/1986 Muldery ..... B28B 7/243 249/120
4,618,408 A * 10/1986 Malavarca ..... G01N 27/44704 204/619
5,226,402 A * 7/1993 Marocco ..... B27B 31/06 125/12
5,520,531 A * 5/1996 Del Monte ..... B28B 7/0008 249/109
5,843,323 A * 12/1998 Ranard ..... E04G 15/02 249/39
5,843,324 A * 12/1998 Shirley ..... E04G 15/02 249/39
6,164,951 A * 12/2000 Rao ..... B28B 7/245 249/120
6,712,598 B2 * 3/2004 Jensen ..... B28B 7/0035 249/137
7,661,649 B2 * 2/2010 Baker ..... B28B 7/0011 249/120
8,246,002 B1 * 8/2012 Baker ..... B28B 7/0011 249/119
9,115,503 B2 * 8/2015 Ciuperca ..... E04B 1/21
10,220,542 B2 * 3/2019 Ciuperca ..... B28B 7/245
10,280,622 B2 * 5/2019 Ciuperca ..... E04G 17/14
2002/0061342 A1 * 5/2002 Jensen ..... B28B 7/0035 425/234
2005/0067551 A1 * 3/2005 Baker ..... B28B 7/0011 249/33
2005/0116131 A1 * 6/2005 Samuel ..... B28B 7/0017 248/357
2006/0250714 A1 * 11/2006 von Limburg ..... B25B 11/002 360/1
2009/0000242 A1 * 1/2009 Waite ..... B28B 7/0064 52/749.1
2009/0065677 A1 * 3/2009 Hoff ..... B28B 7/245 249/13

FOREIGN PATENT DOCUMENTS

| | | | |
|---|---|---|---|
| CN | 102811851 | A | 12/2012 |
| CN | 203973740 | U | 12/2014 |
| CN | 204195939 | U | 3/2015 |
| CN | 204195951 | U | 3/2015 |
| DE | 1936883 | U | 4/1966 |
| DE | 70811 | A1 | 1/1970 |
| DE | 1584475 | A1 | 1/1971 |
| DE | 2001825 | A1 | 7/1971 |
| DE | 2139661 | A1 | 2/1972 |
| DE | 2322139 | A1 | 3/1974 |
| DE | 102015209157 | B4 | 3/2017 |
| JP | S49016092 | B1 | 4/1974 |
| JP | S51148717 | A | 12/1976 |

OTHER PUBLICATIONS

Japanese Patent Office, Office Action Issued in Application No. 2018-512489, dated Mar. 5, 2019, 7 pages.

(56) References Cited

OTHER PUBLICATIONS

State Intellectual Property Office of the People's Republic of China, Office Action and Search Report Issued in Application No. 201680034791.7, dated Apr. 3, 2019, 11 pages. (Submitted with Partial Translation).

International Bureau of WIPO, English Translation of the Written Opinion Issued in Application No. PCT/EP2016/061220, Translation Available Oct. 4, 2017, Originally Issued Oct. 20, 2016, WIPO, 7 pages.

* cited by examiner

FORMWORK DEVICE

CROSS-REFERENCE TO RELATED APPLICATIONS

The present application is a U.S. National Phase of International Patent Application Serial No. PCT/EP2016/061220, entitled "FORMWORK DEVICE" filed on May 19, 2016. International Patent Application Serial No. PCT/EP2016/061220 claims priority to German Patent Application No. 10 2015 209 157.0, filed on May 19, 2015. The entire contents of each of the above-cited applications are hereby incorporated by reference in their entirety for all purposes.

TECHNICAL FIELD

The present invention relates to a formwork device for a battery formwork for the manufacture of structural elements, in particular prefabricated concrete elements, which comprises at least two partition walls.

BACKGROUND AND SUMMARY

Battery formworks are often used in the series production of prefabricated concrete elements. Prefabricated concrete elements are often used, in particular, for building houses with precast concrete slabs. These prefabricated concrete elements can be produced quickly and cheaply in battery formwork. With conventional battery formwork, so-called partition walls are used as formwork devices and arranged adjacent to each other. The partition walls each span vertical planes. Disposed between the partition walls are formwork elements e.g. for doors, windows, etc., which, together with the partition walls arranged on both sides, each define cavities to be filled with concrete. The partition walls are equipped with the respective formwork elements as needed. For this purpose, a worker attaches the formwork elements e.g. with magnetic supports on the partition walls made of steel. During production, the partition walls are clamped (braced) against each other to ensure sufficient tightness of the cavities. The cavities are open at the top and are filled with concrete for producing the prefabricated concrete elements. The cavities arranged between the partition walls are filled with concrete substantially simultaneously. After the concrete has cured, the bracing is released and the cured prefabricated concrete elements can be removed from the battery formwork. The simultaneous production of several prefabricated concrete elements makes it possible to produce prefabricated concrete elements in a rapid and cheap manner with the battery formwork. On the other hand, handling the large and relatively heavy partition walls is not very easy. Also, fitting the partition walls with formwork elements is quite laborious. It is therefore desirable and the object of the invention to further simplify the production of prefabricated concrete elements. In particular, further flexibility in the production process would be desirable.

This object is satisfied according to the invention by a formwork device for a battery formwork for the production of structural elements, in particular prefabricated concrete elements, which comprises at least two partition walls, and the formwork device comprises two formwork panels that are connected to one another preferably in an articulated manner in order to be transferred from an unfolded state to a folded state, where each formwork panel comprises a formwork front side for attaching formwork elements and a formwork rear side, and the formwork rear sides of the two formwork panels face each other in the folded state and the formwork device is intended to be positioned in the folded state between the partition walls.

This solution provides the advantage that a formwork device comprising two formwork panels can be used for the simultaneous production of two different prefabricated concrete elements. In particular, formwork elements, e.g. for doors and windows for a prefabricated concrete element, can be attached to the one formwork panel, whereas formwork elements for another prefabricated concrete element can at the same time be attached to the other formwork panel. For producing the prefabricated concrete elements, the formwork device is positioned between two adjacent partition walls. Due to the possibility of transferring the formwork panels from the unfolded to the folded state, it is possible to equip the formwork panels in the unfolded state with the respective formwork elements while they are lying down. The formwork panels are subsequently raised and transferred to the folded state in which the formwork panels can be suspended between the partition walls. As a result, fitting the formwork panels can be greatly simplified as compared to conventional battery formwork. The possibility of fitting the formwork panels in the lying down state with formwork elements also facilitates automation of this process.

Advantageously, the formwork panels can be formed substantially rectangular. Their shape then corresponds substantially to the shape of the partition walls, so that compatibility with the partition walls is ensured. This can be advantageous, in particular, for a possible retrofit of existing battery formwork. It can be advantageous if the substantially rectangular formwork panels are connected to one another on one side, preferably on the longer longitudinal side. The connection is thereby effected along a line extending horizontally during the insertion process of the folded formwork panels. As a result, the two formwork panels extend downwardly starting from this line, hang down from this line, so to speak. In this way, simple handling of the formwork device is possible.

It can also be advantageous to have the formwork panels be connected to each other by way of a hinge joint. Handling can be further simplified in this way, in particular, by transferring them from the unfolded to the folded state.

In one advantageous further development of the invention, at least the formwork front side of the formwork panel can be magnetic. For example, the formwork panel can at least in part be made of steel. In this way, magnetic formwork elements can be attached to the formwork panel, whereby handling is even further simplified and the formwork device can be used even more efficiently.

It can also be favorable to have the formwork device comprise at least one roller. The formwork device can then be easily positioned and moved in the battery formwork.

It can also be advantageous to have the roller be provided on a narrow side of the formwork device and preferably in the region where the two formwork panels adjoin each other. With such a configuration, the formwork device can be handled in an even easier manner in the battery formwork.

It can also prove to be advantageous to have the roller be arranged at the hinge joint. Such an arrangement is particularly advantageous for battery formwork in which the partition walls and/or the formwork device are arranged in a suspended manner. Independent unfolding of the formwork panels can thereby be counteracted.

In one advantageous development of the invention, the formwork device can comprise a preferably detachably arranged heating device and/or a vibrator. Both the heating device as well as the vibrator can be detachably mounted.

This makes it possible to use the formwork devices in a more universal manner. It is no longer necessary to use expensive partition walls with fixedly mounted vibrators. Instead, the formwork device can be equipped with a heating device and/or with a vibrator as needed. The heating device and/or the vibrator can be mounted in particular when fitting the formwork panels with formwork elements. It is conceivable to attach the heating device and/or the vibrator with magnetic supports to the formwork element.

Furthermore, it can prove to be advantageous to have a filler neck be provided on an end portion of the formwork device disposed opposite to the articulated connection, preferably the hinge joint. Such a filler neck can be attached in the lower region of the formwork device when the formwork device is suspended in the battery formwork. It is then possible to fill in the concrete from below. With formwork elements arranged in a suspended manner, the filler neck can optionally be arranged at the bottom on the face side. Preferably, however, it is located at a lower end portion laterally on the formwork device. Such a filler neck can also be designed as a permanent member. It then remains in the molded prefabricated concrete elements and the part not needed can then e.g. be cut off.

The above object is also satisfied by an arrangement consisting of a battery formwork and at least one formwork device according to the invention, where the formwork device is arranged suspended in the battery formwork.

This solution has the advantage that no continuous hard floor e.g. made of concrete, is necessary under the battery formwork and in particular under the suspended formwork device. The requirements for the installation site of the battery formwork are thereby reduced, and the battery formwork can be used in a more universal manner.

It can be advantageous to have the battery formwork comprise at least one support device, preferably a rail, for receiving the roller of the formwork device. The formwork device can be easily moved in the battery formwork in this way.

Furthermore, the invention relates to a formwork device for a battery formwork with at least two partition walls, in which a formwork panel is arranged between the partition walls which formwork panel comprises a front side and a rear side and the front side is associated with one partition wall and the rear side is associated with the other partition wall, and the formwork panel with its front and rear sides and the respectively associated partition walls each define at least one cavity for filling in concrete.

Unlike the previously discussed embodiment, only one formwork panel is provided in this embodiment and can preferably be equipped with formwork elements on both sides. As a result, the formwork device has a double effect and allows for further simplification of a formwork for prefabricated concrete elements in battery formwork.

Furthermore, at least one formwork mold can be provided between the partition walls in both embodiments according to the invention. Such molds can comprise prefabricated arrangements of formwork elements and are positioned between the partition walls and possibly fastened to the partition wall or the formwork device. As a result, the fitting effort can be further reduced. Such molds can also represent only parts of a formwork element. For example, the mold can form an exchangeable core for simple production of different variants of a prefabricated concrete element. Complicated geometries can also be realized therewith, which are difficult to realize with conventional formwork elements. A collection of molds can exist that allows for the production of different prefabricated concrete elements in a simple manner The above-mentioned features of the formwork device are suitable for partition walls which are suspended, as in the present preferred version of the invention, but are also generally suitable for such partition walls that are mounted on chassis. The partition walls are then supported on the ground and can also be moved e.g. on rails.

BRIEF DESCRIPTION OF THE FIGURES

The invention shall be explained in more detail below with reference to one embodiment and the associated drawings.

These drawings show.

DETAILED DESCRIPTION

Figure 1:
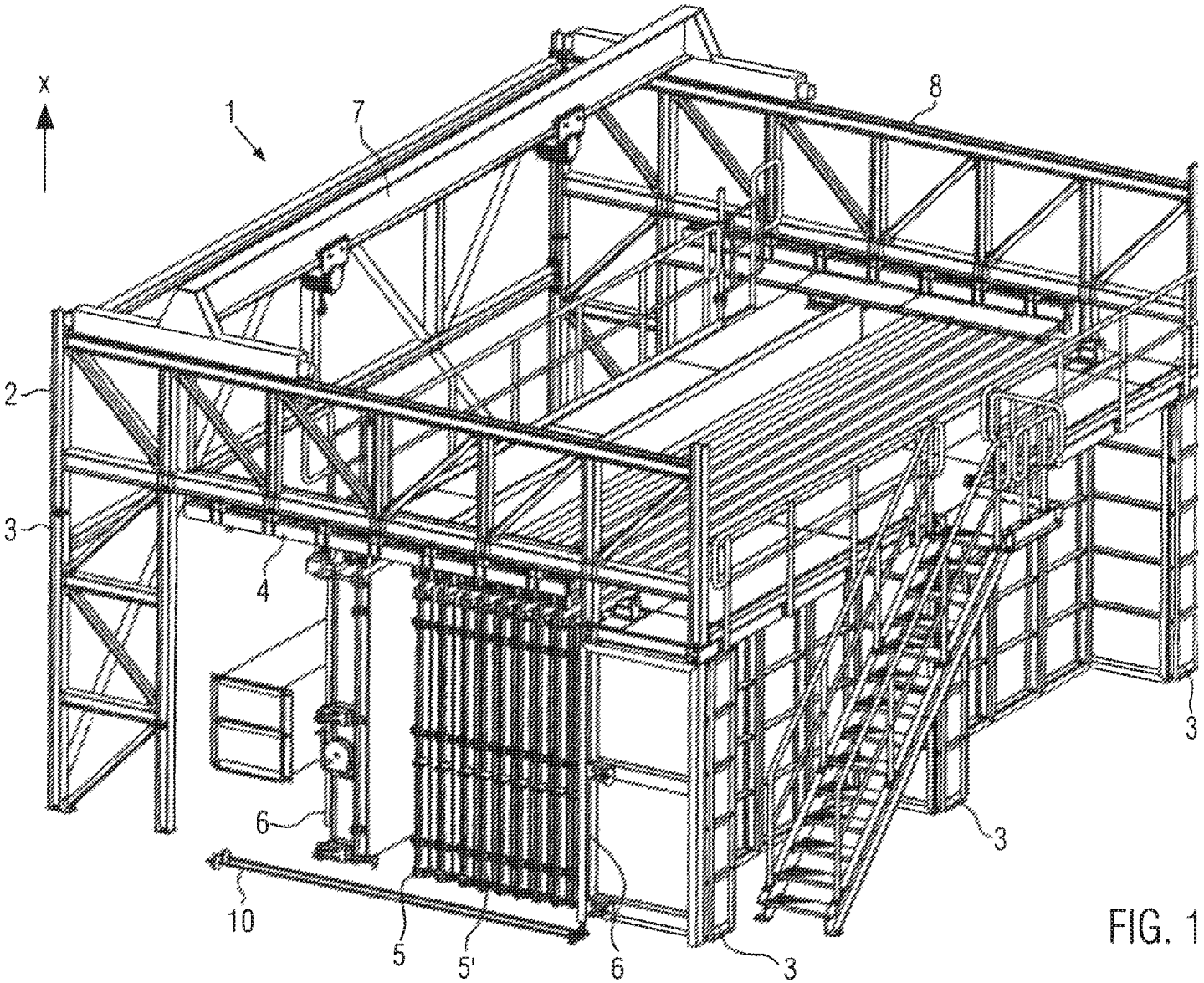
FIG. 1 a schematic representation of a battery formwork with formwork devices.

FIG. 1 shows a schematic representation of a battery formwork 1 with formwork devices 5. Battery formwork 1 is used for the production of structural elements, not shown, and in particular of prefabricated concrete elements for buildings. Battery formwork 1 comprises a support frame 2 with bearing sections 3 spaced from each other. The number of bearing sections 3 in FIG. 1 is only by way of example and can be adapted to the circumstances. Furthermore, battery formwork 1 comprises two support devices 4 in which partition walls 5' (bulkhead walls) and formwork devices 5 are received in a suspended and movable manner, i.e. in the present embodiment, in a slidable manner Formwork devices 5 are there located between the partition walls 5'. A cavity to be filled with concrete is formed between at least one partition wall 5' and one formwork device 5, where formwork device 5 preferably supports formwork elements 18 which define the contour of the prefabricated concrete element. Formwork elements 18 can define e.g. door or window openings and also seal the cavity filled with concrete when concrete is poured. Formwork elements 18 can be fastened to formwork device 5 e.g. with magnetic supports. In addition, a heating device and/or a vibrator can further be mounted on formwork device 5.

In the embodiment of FIG. 1, formwork device 5 can be plate-shaped and be provided with respective formwork elements 18 on one side or on both sides. If formwork device 5 is provided with formwork elements 18 on both sides, it can serve to produce different prefabricated concrete elements 27, 28 on each side. Formwork device 5 equipped with formwork elements on both sides, as well as formwork device 5 equipped with formwork elements 18 on one side, are inserted between two partition walls 5' and clamped thereto when concrete is poured.

The number of support devices 4, partition walls 5' and formwork devices 5 is to be regarded as only by way of example and can be varied depending on the circumstances. E.g. formwork devices 5 can be provided for the outer walls, inner walls, the floor and the roof of a house, so that the structural elements for an entire building can be produced at the same time with battery formwork 1. Partition walls 5' and formwork devices 5 can be clamped between two strut devices 6. The number of strut devices 6 is also to be considered as being by way of example only, and can be varied according to requirements. At least one strut device 6 is received movably, i.e. slidably in the present embodiment, in support devices 4. For stabilization, formwork devices 5 and strut devices 6 can be connected and clamped to each other in the concrete pouring position by one or more rod-shaped connecting devices 10. The number of connecting devices 10 can be adapted to the circumstances. Also hydraulic connecting devices are possible instead of rod-shaped connecting devices 10. However, rod-shaped connecting devices 10 are particularly robust and easy to handle.

Figure 4:
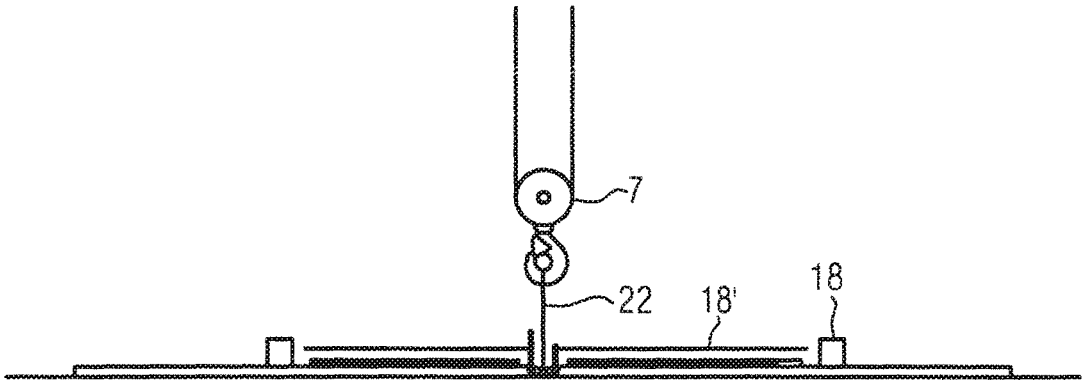
FIGS. 4 to 7 the work steps involved in transferring the formwork device from the unfolded state to the folded state.
Figure 5:
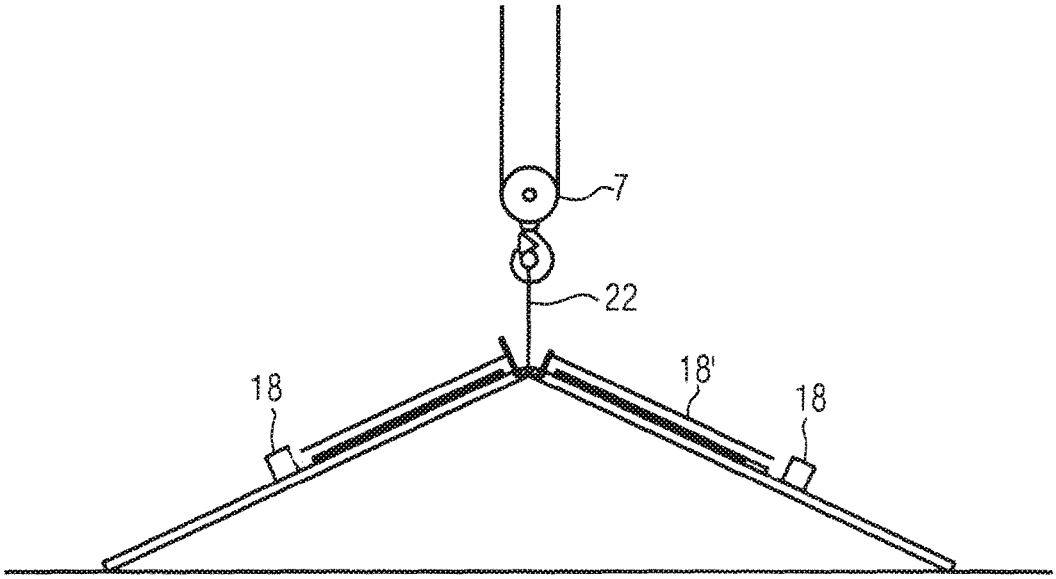
Figure 7:
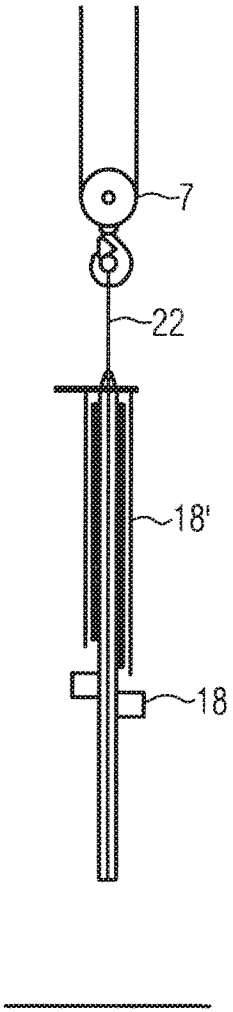
Figure 6:
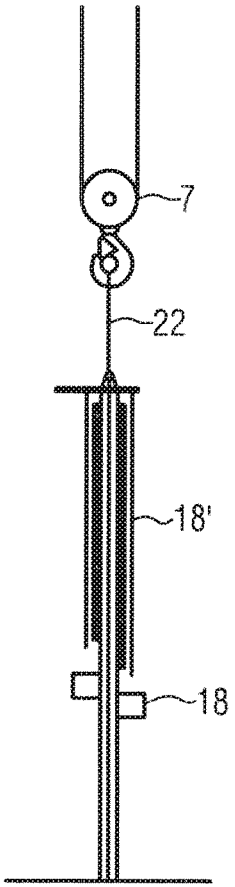
Figure 9:
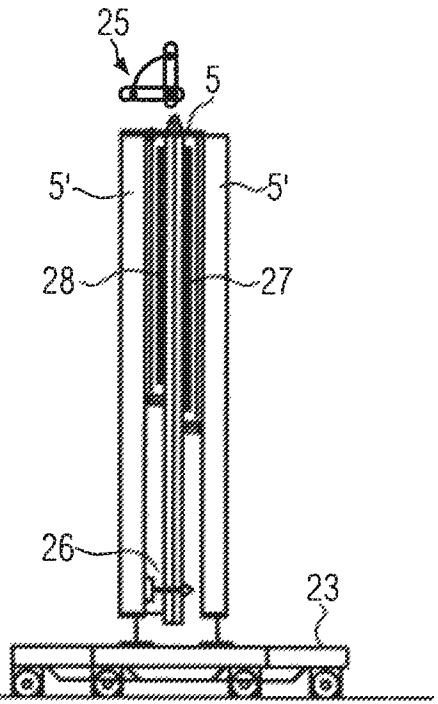
FIGS. 8 to 11 the formwork device according to the invention mounted between two partition walls on a chassis.
Figure 8:
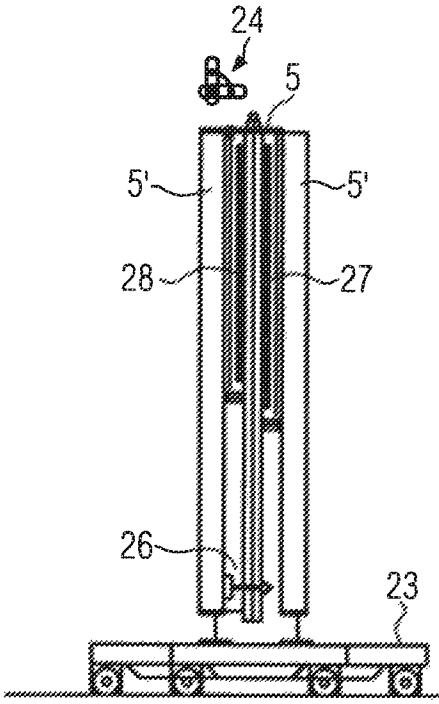
Figures 10, 11:
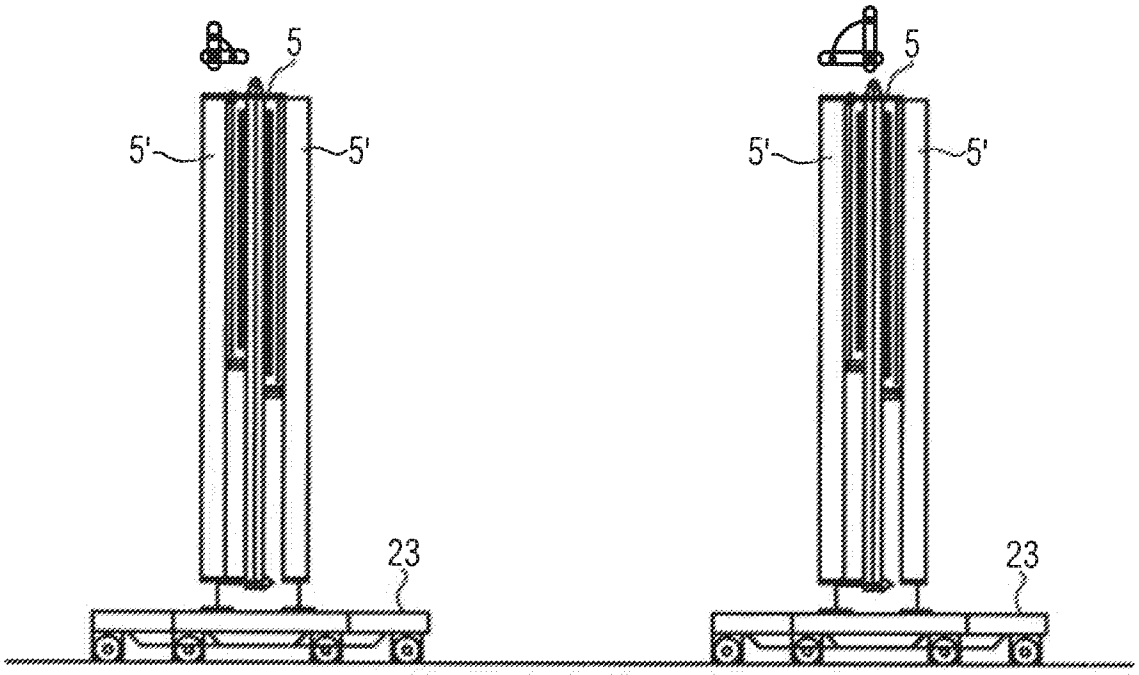

FIGS. 4 to 7 show how a formwork device 5 according to the invention is transferred from the unfolded state to the folded state. FIG. 4 shows formwork device 5 in the unfolded state with formwork elements 18 and schematically illustrated reinforcement 18'. Lifting device 7 is raised e.g. by way of a support cable 22 in the region of the hinge joint and transferred to the state shown in FIG. 6. According to FIG. 7, formwork device 5 is raised and inserted into battery formwork 1 between two partition walls 5'.

In the illustration according to FIGS. 8 to 11, formwork device 5 according to the invention is drawn in between two partition walls 5'. It can be seen how formwork elements 18 together with partition walls 5' and formwork device 5 define (delimit) two cavities which are open to the top and can be filled with concrete. Before filling in concrete, partition walls 5' are clamped against each other, thereby ensuring the tightness of the cavity. In the illustration according to FIGS. 8 to 11, the two partition walls 5' are disposed on a chassis 23. According to the invention, however, partition walls 5' can also be arranged in a suspended manner. The invention prefers the suspended arrangement. However, FIGS. 8 to 11 illustrate that also an arrangement is possible, in principle, in which partition walls 5' rest on chassis 23 on the ground. Formwork devices 5 are connected to partition walls 5' by way of fastening devices 24 to 26. Fastening devices 26, such as a bolt connection, are provided in the lower region of partition walls 5' which are arranged in an upright manner. Disposed in the upper region are pivotable fastening elements 24 and 25, with which formwork device 5 can be detachably connected to partition walls 5'.

Figures 12, 13:
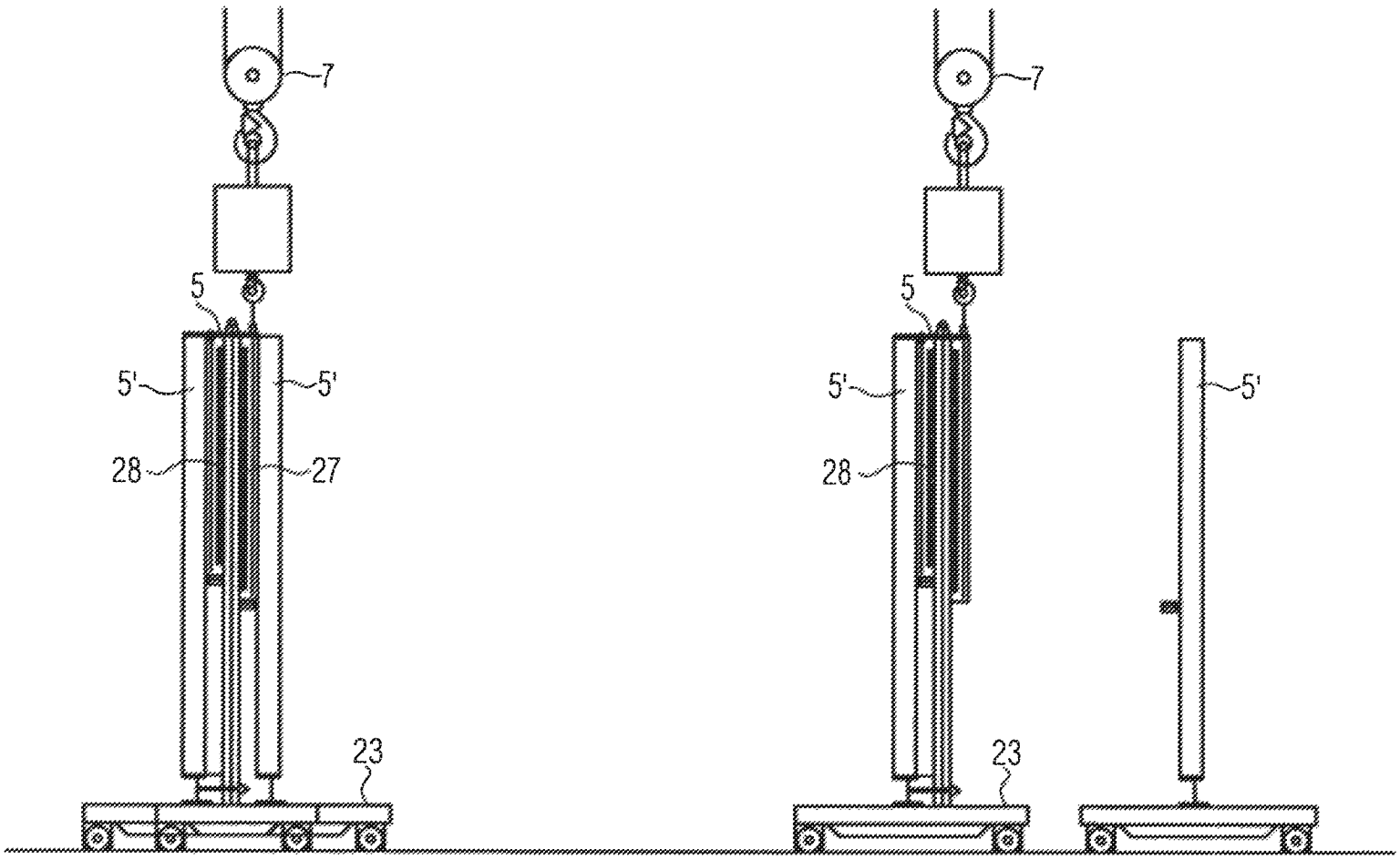
FIGS. 12 to 19 the work steps in removing the finished prefabricated concrete elements.
Figures 14, 15:
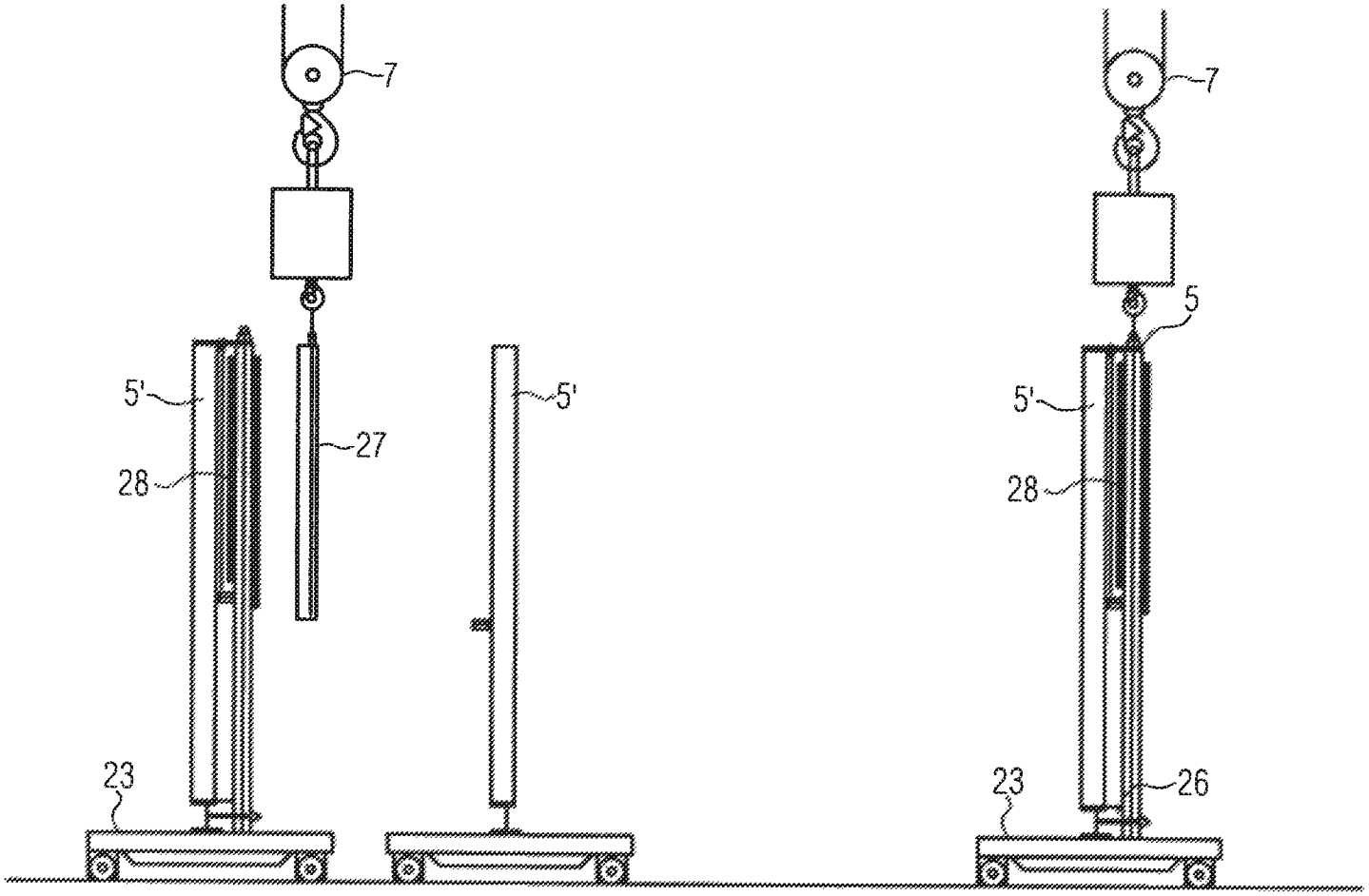
Figures 16, 17:
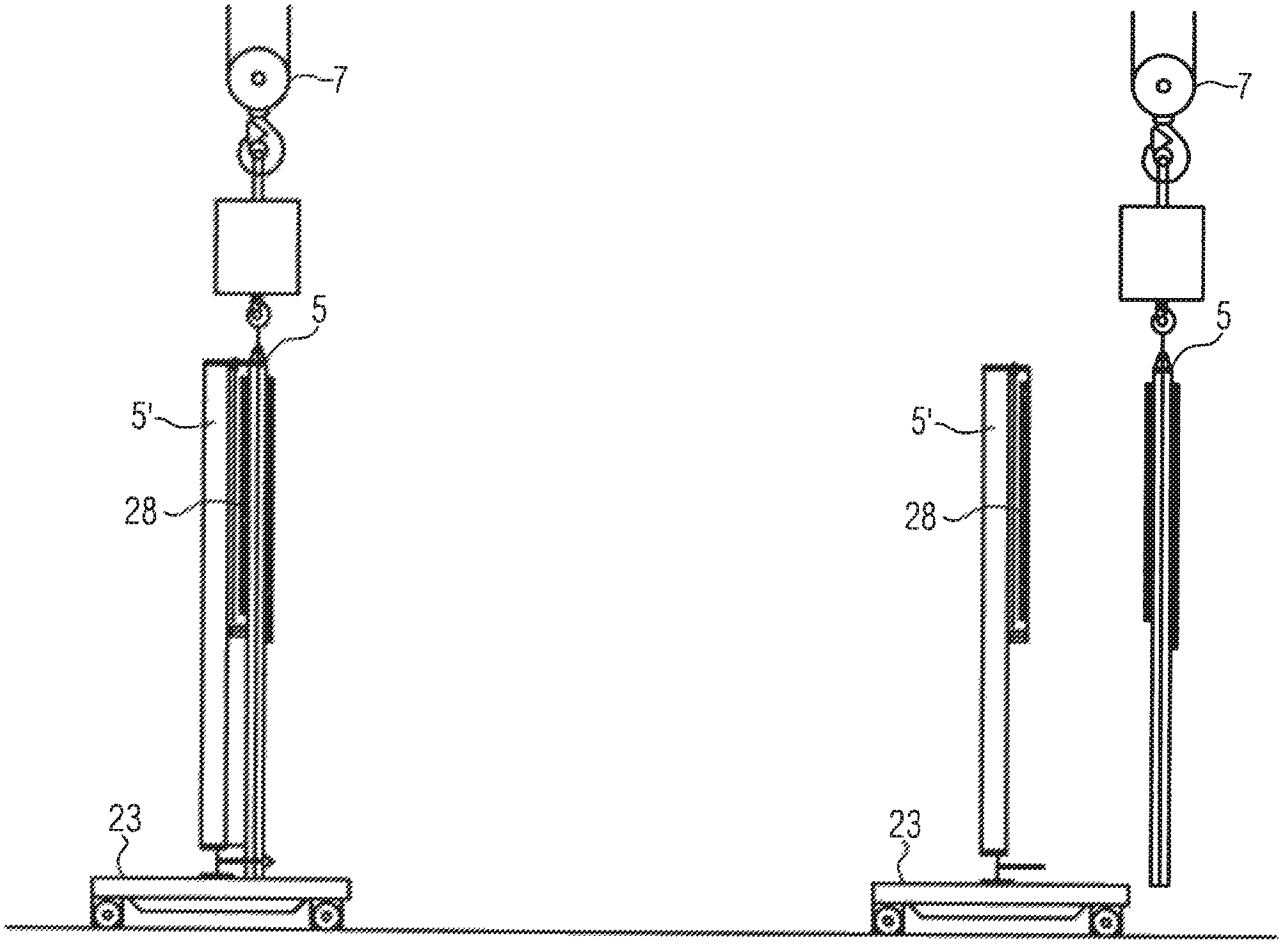
Figure 19:
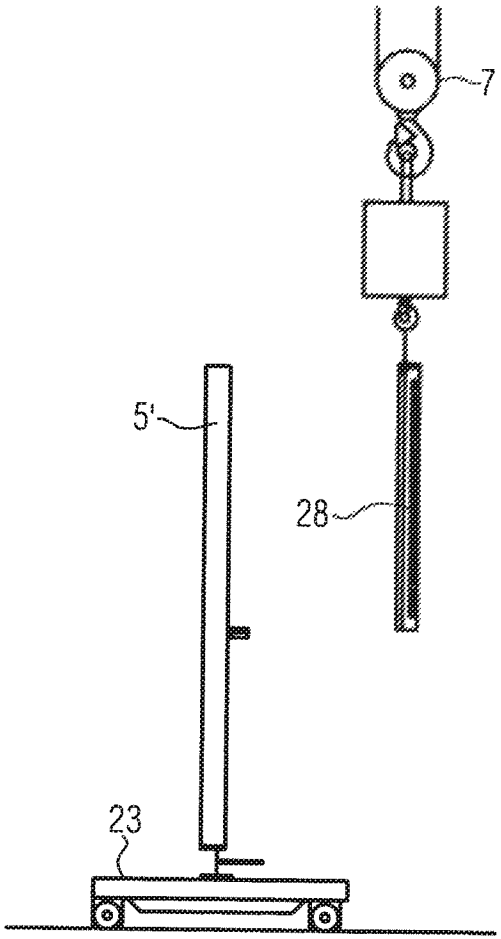
Figure 18:
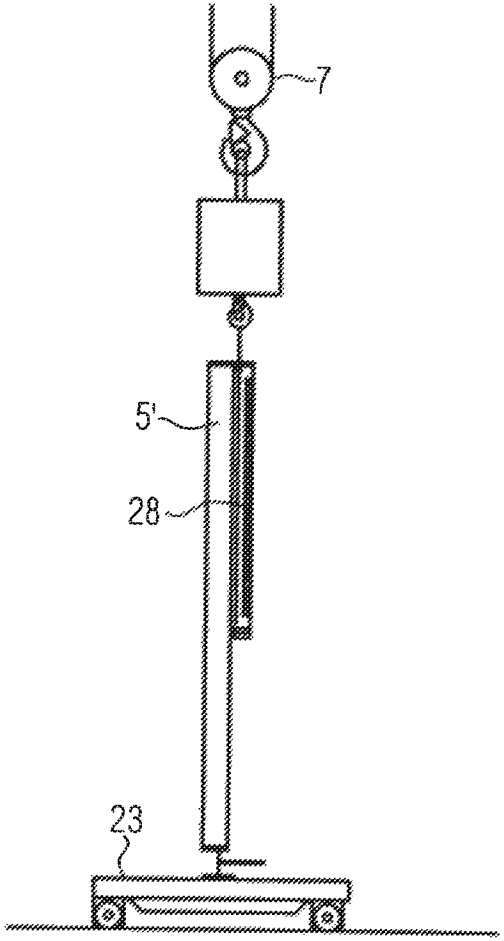

FIGS. 12 to 19 show the sequence of demolding the prefabricated concrete elements after having cured. Lifting device 7 first supports prefabricated concrete element 27 shown in the illustration on the right-hand side and prevents it from falling down when partition wall 5' on the right-hand side is removed, as shown in FIG. 13. In this embodiment, formwork element 18 is respectively fastened to partition walls 5'. Formwork elements 18, however, are preferably disposed on formwork device 5. In FIG. 14, prefabricated concrete element 27 on the right-hand side is now removed. Formwork device 5 is subsequently raised with lifting device 7 and connection 26 is released to allow formwork device 5 to be removed. Prefabricated concrete element 28 in the illustration on the left-hand side has previously been secured to partition wall 5' by way of fastening device 24. Prefabricated concrete element 28 is then raised and lock 24 is released. The prefabricated concrete element can now be removed as shown in FIG. 19.

In battery formwork 1 according to the invention, formwork devices 5 are suspended from above into support devices 4, so that, in the suspended state, they are spaced from the ground between bearing sections 3 in a concrete pouring position. Furthermore, battery formwork 1 comprises a lifting device 7 with which at least one of formwork devices 5 can be transferred from the lowered concrete-pouring position to a raised transport position in which formwork device 5 can be conveyed via a formwork device 5, that is in the concrete-pouring position, in a direction substantially perpendicular to lifting direction X. The configuration of lifting device 7 can be adapted to the requirements. If necessary, several lifting devices 7 can be employed.

Lifting device 7 is movable in a tensioning direction of formwork devices 5 on two spaced guide devices 8, which are presently configured as runner rails 8. Furthermore, guide devices 8 are arranged above support devices 4 and in parallel thereto. In order to configure battery formwork 1 in a more compact manner, formwork devices 5 are attached to the support devices 4 at their upper end.

Battery formwork 1 can comprise at least one weighting device, not shown, with a cavity which can preferably be filled with sand, water and/or concrete. Furthermore, the weighting device can be designed to be emptied and/or it can be removable. This can increase the stability and sturdiness of battery formwork 1.

The filling process can be adapted to the respective conditions at the sites where battery formwork 1 is set up. E.g. filling with sand can be advantageous in desert regions. Battery formwork 1 can be easily transported by emptying the weighting device when filled with sand or water, or when removing the weighting device e.g. when it is filled with concrete.

The fact that battery formwork 1 is modular and can be disassembled, so that each modular component can be transported in a standard 20 feet or 40 feet container also contributes to the transportation of battery formwork 1 being facilitated. In this manner, battery formwork 1 can be rapidly taken to places where living space is quickly needed, e.g. refugee camps.

Battery formwork 1 can be equipped with formwork devices 5 which are configured such that the parts (floor, side walls, inner walls, roof) for the production of an entire building, consisting e.g. of 12 parts, can be produced simultaneously with battery formwork 1.

Battery formwork 1 is configured such that the lifting height of a formwork device 5 or a partition wall 5' with lifting device 7 corresponds to at least twice the height, preferably 2.5 times the height of formwork device 5.

Formwork devices 5 and strut devices 6 can be arranged such that sufficient space for storing or loading the demolded prefabricated concrete elements or formwork elements 5 remains between a strut device 6 and bearing sections 3, which are arranged on one side of battery formwork 1.

Battery formwork 1 shown in FIG. 1 comprises yet further parts, such as a staircase or a handrail. These parts, their number and arrangement are to be regarded as being by way of example only. Such parts may be added or omitted as required.

Figure 2:
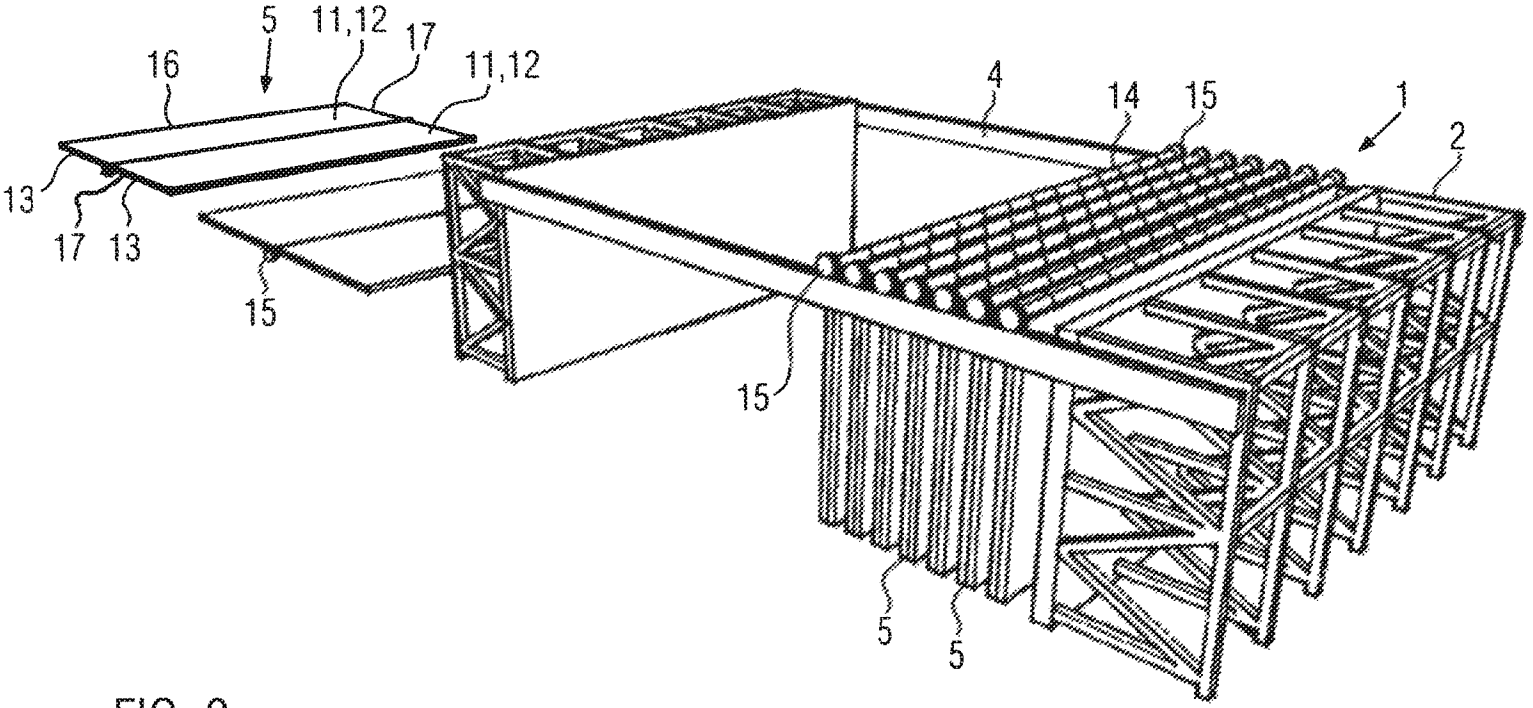
FIG. 2 a schematic representation of a battery formwork with one embodiment of the formwork device according to the invention and FIG. 3 a schematic representation of a conveyor device for conveying the formwork device according to the invention.

FIG. 2 shows a schematic representation of a battery formwork 1 with an embodiment of a formwork device 5 according to the invention for the production of structural elements, not shown, in particular prefabricated concrete elements. Battery formwork 1 of FIG. 2 is similar to battery formwork 1 of FIG. 1. For reasons of clarity, the attachments such as stairs, handrail, etc., and lifting device 7 of FIG. 1 have been omitted. Same structural elements have the same reference numerals. Battery formwork 1 of FIG. 2 differs from battery formwork 1 of FIG. 1 substantially only by the different configuration of formwork devices 5.

Figure 3:
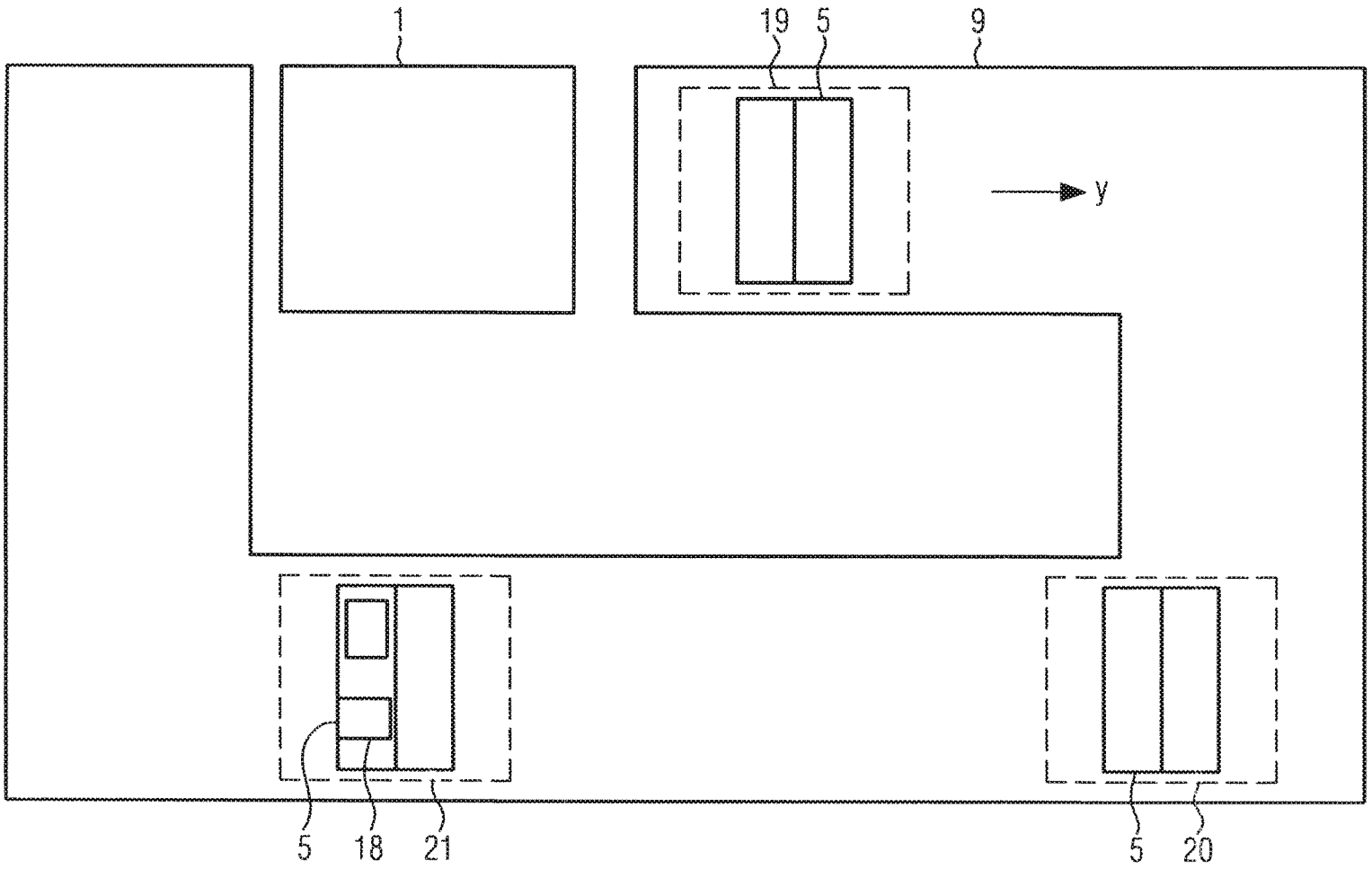

Formwork device 5 according to the invention shown in FIG. 2 comprises two formwork panels 11 which are connected to each other in an articulated manner in order to be transferred from an unfolded state to a folded state. Formwork panels 11 outside battery formwork 1 show the unfolded state, and formwork devices 5 disposed within battery formwork 1 show the folded state. Each formwork panel 11 has a formwork front side 12 for attaching formwork elements 18, as shown in FIG. 3, and a formwork rear side 13. In the folded state, the formwork rear sides 13 of the two formwork panels 11 face each other. Formwork panels 11 are shaped substantially rectangular, so that also the formwork device is shaped substantially rectangular. Such a shape facilitates handling formwork device 5. However, the shape of formwork device 5 depends on the component to be produced. Therefore, the shape of formwork device 5 shown is only by way of example and can be adapted to the circumstances. The dimension of a formwork panel 11 preferably corresponds to the dimension of a partition wall 5'.

Formwork panels 11 are connected to one another on one side at the longer longitudinal side 16. Handling of formwork device 5 can be simplified if formwork panels 11 are connected to each other by way of a hinge joint 14. At least formwork front side 12 of formwork panel 11 can be magnetic in order to facilitate fitting formwork elements 18, as shown in the example in FIG. 3.

As already mentioned above, the configuration of formwork device 5 depends on the component to be produced. Therefore, formwork panels 11 can also be connected to each other on one side other than the longer longitudinal side 16, and can comprise a connection that is different from a hinge joint 14. If an attachment e.g. with bolts instead of the magnetic option is selected as the attachment of formwork elements 18 to formwork panel 11, then it is not necessary that formwork front side 12 of formwork panel 11 be magnetic.

In contrast to formwork device 5 shown in FIG. 1, formwork device 5 according to the invention of FIG. 2 comprises two formwork panels 11, which are connected to one another in an articulated manner. In addition, formwork device 5 according to the invention shown in FIG. 2 has a roller 15 on each narrow side 17 in the region where the two formwork panels 11 adjoin each other. Rollers 15 are arranged at hinge joint 14. The number and arrangement of rollers 15 can be varied depending on the circumstances.

Formwork devices 5 can be moved easier with rollers 15 in battery formwork 1.

FIG. 3 shows a schematic representation of battery formwork 1 and of a conveyor belt 9 for conveying formwork device 5 according to the invention.

A soiled formwork device 5 is placed from battery formwork 1 in the unfolded state and with formwork front side 12 facing upwardly onto a receiving region 19 of conveyor belt 9. From there, formwork device 5 is conveyed in the conveying direction Y to a cleaning region 20 where formwork device 5 is cleaned and, in particular, freed from concrete residue. Formwork elements 18 that are no longer needed later can also be removed there.

Formwork device 5 is subsequently conveyed to a fitting region 21 where new formwork elements 18 can be mounted.

Formwork device 5 is conveyed from fitting region 21 back to battery formwork 1 into which it is then subsequently suspended. This sequence is to be regarded as being by way of example only and can be adapted as needed. In particular, the number, arrangement and configuration of regions 19, 20, 21 can be varied according to requirements.

Fastening device 24 is intended to temporarily secure prefabricated concrete elements 28 when formwork device 5 is removed. Fastening device 25 is intended to temporarily secure formwork device 5 to partition wall 5' on the left-hand side in the illustration, while prefabricated concrete element 27 is removed. Fastening devices 24 and 25 are there configured as a folding brackets to allow formwork device 5 or prefabricated concrete element 28 to be temporarily secured. In the illustration according to FIGS. 12 to 19, partition walls 5' are mounted on chassis. As already explained above, the same sequence of operations can also be performed with such partition walls 5' that are suspended.

Figure 20:
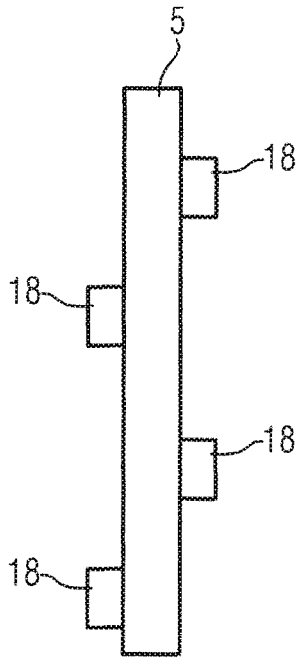
FIG. 20 a second embodiment of the formwork device.

FIG. 20 shows a second embodiment of formwork device 5 in which formwork elements 18 are arranged on both sides of formwork device 5.

Handling of formwork device 5 is significantly facilitated due to the fact that formwork device 5 according to the invention comprises two formwork panels 2 which are connected to each other in an articulated manner to be transferred from an unfolded state to a folded state. Formwork device 5 according to the invention can be used more efficiently than conventional formwork devices, whereby the production costs for structural elements can be reduced.

The invention claimed is:

1. A formwork device for a battery formwork for production of structural elements which comprises at least two partition walls, wherein the formwork device comprises two formwork panels that are connected to one another in order to be transferred from an unfolded horizontal state to a folded vertical state, where each formwork panel comprises a formwork front side for attaching formwork elements and a formwork rear side, wherein the formwork rear sides of the two formwork panels face each other in the folded state and the formwork device is positioned in the folded state between the partition walls, wherein the structural elements are prefabricated concrete elements, and wherein the formwork panels are connected to one another in an articulated manner.

2. The formwork device according to claim 1, wherein the formwork panels are substantially rectangular and are connected to each other.

3. The formwork device according to claim 2, wherein the formwork panels are connected to each other on one side.

4. The formwork device according to claim 3, wherein the formwork panels are connected on a longer longitudinal side.

5. The formwork device according to claim 1, wherein the formwork panels are connected to each other by way of a hinge joint.

6. The formwork device according to claim 5, wherein the formwork device comprises at least one roller.

7. The formwork device according to claim 6, wherein the roller is provided on a narrow side of the formwork device.

8. The formwork device according to claim 6, wherein the roller is arranged at the hinge joint.

9. The formwork device according to claim 7, wherein the roller is provided in a region where the two formwork panels adjoin each other.

10. The formwork device according to claim 5, wherein a filler neck is provided at an end portion disposed opposite to a connection of the two formwork panels.

11. The formwork device according to claim 10, wherein the filler neck is provided at the hinge joint.

12. The formwork device according to claim 1, wherein at least the formwork front side of the formwork panels is magnetic.

13. The formwork device according to claim 1, wherein a detachably mounted heating device and/or a vibrator is provided on the formwork device.

14. An arrangement consisting of a battery formwork and at least one formwork device, wherein the formwork device comprises two formwork panels that are connected to one another, in order to be transferred from an unfolded horizontal state to a folded vertical state, wherein each formwork panel comprises a formwork front side for attaching formwork elements and a formwork rear side, wherein the formwork rear sides of the two formwork panels face each other in the folded state and the formwork device is positioned in the folded state between partition walls, wherein structural elements are prefabricated concrete elements, wherein the formwork panels are connected to one another in an articulated manner forming a hinge joint, wherein the formwork device comprises at least one roller, and wherein the formwork device is arranged suspended in the battery formwork.

15. The arrangement according to claim 14, wherein the battery formwork comprises at least one support device for receiving the at least one roller of the formwork device.

16. The arrangement according to claim 15, wherein the at least one support device is a rail.

* * * * *